US006354689B1

(12) United States Patent
Couwenhoven et al.

(10) Patent No.: US 6,354,689 B1
(45) **Date of Patent: *Mar. 12, 2002**

(54) METHOD OF COMPENSATING FOR MALPERFORMING NOZZLES IN A MULTITONE INKJET PRINTER

(75) Inventors: Douglas W. Couwenhoven, Fairport; Lam J. Ewell; Xin Wen, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/218,615

(22) Filed: Dec. 22, 1998

(51) Int. Cl.[7] ..... B41J 29/393
(52) U.S. Cl. ..... 347/19
(58) Field of Search ..... 347/19, 14, 9, 347/12, 37; 358/406

(56) References Cited

U.S. PATENT DOCUMENTS

| | | | | |
|---|---|---|---|---|
| 4,165,363 A | | 8/1979 | Weigert et al. | 423/342 |
| 4,489,335 A | | 12/1984 | Watanabe et al. | 346/140 |
| 4,560,997 A | | 12/1985 | Sato et al. | 346/140 R |
| 4,907,013 A | * | 3/1990 | Hubbard et al. | 347/19 |
| 4,959,659 A | | 9/1990 | Sasaki et al. | 346/1.1 |
| 4,963,882 A | | 10/1990 | Hickman | 347/41 |
| 4,967,203 A | | 10/1990 | Doan et al. | 346/1.1 |
| 5,124,720 A | | 6/1992 | Schantz | 346/1.1 |
| 5,455,608 A | | 10/1995 | Stewart etal. | 347/23 |
| 5,659,342 A | | 8/1997 | Lund et al. | 347/35 |

FOREIGN PATENT DOCUMENTS

| | | | | |
|---|---|---|---|---|
| EP | 0376596 A3 | * | 12/1989 | 347/19 |
| EP | 0783973 A2 | * | 7/1997 | 347/19 |
| EP | 0863004 A2 | * | 3/1998 | 347/19 |
| EP | 0 855 270 A2 | | 7/1998 | B41J/2/04 |
| JP | 406226982 | * | 8/1994 | 347/19 |
| WO | WO 99/08875 | * | 7/1998 | 347/19 |

* cited by examiner

*Primary Examiner*—John Barlow
*Assistant Examiner*—Julian D. Huffman
(74) *Attorney, Agent, or Firm*—David M. Woods

(57) ABSTRACT

The present invention generally relates to a method and apparatus for compensating for malperforming or inoperative ink nozzles in a multitone ink jet printhead so that high quality images are printed although some ink nozzles are malperforming or inoperative. Multitone printing is effected by printing a variety of droplets of varying volumes at a given pixel location. In compensating for a malperforming nozzle, a swath data signal is modified and one or more functional nozzles are assigned the printing data for a malperforming nozzle such that the volume of ink ultimately printed at pixel locations is substantially unchanged and the resulting image is free from degradation. Additionally, malperforming nozzles may be assigned values which represent the degree of image degradation that would be caused by printing with the malperforming nozzles, such that these values may be taken into consideration during the process of modifying the swath data signal for complementary recording.

8 Claims, 8 Drawing Sheets

| NOZZLE NUMBER (n) | NOZZLE MALPERFORMANCE VALUE m(n) |
|---|---|
| 0 | 0 |
| 1 | 0 |
| 2 | 0 |
| 3 | 0 |
| 4 | 0 |
| 5 | 2 |
| 6 | 0 |
| 7 | 0 |
| 8 | 3 |
| 9 | 2 |
| 10 | 0 |
| 11 | 0 |
| 12 | 0 |
| 13 | 0 |
| 14 | 10 |
| 15 | 0 |
| 16 | 0 |
| 17 | 0 |
| 18 | 0 |
| 19 | 3 |
| 20 | 0 |
| 21 | 1 |
| 22 | 0 |
| 23 | 0 |

FIG. 4

| STATE NUMBER (s) | STATE IMPORTANCE VALUE j(s) |
|---|---|
| 0 | 0 |
| 1 | 3 |
| 2 | 10 |

FIG. 5

| | $A_0$ | $A_1$ |
|---|---|---|
| $D_0$ | (0,0) | (0,0) |
| $D_1$ | (0,1) | (0,1) |
| $D_2$ | (1,1) | (0,2) |
| $D_3$ | (0,2) | (0,2) |
| ⋮ | ⋮ | ⋮ |
| ⋮ | ⋮ | ⋮ |
| $D_i$ | (1,2) | (0,3) |
| ⋮ | ⋮ | ⋮ |
| ⋮ | ⋮ | ⋮ |
| $D_{max}$ | (3,3) | (0,6) |

*FIG. 9*

METHOD OF COMPENSATING FOR MALPERFORMING NOZZLES IN A MULTITONE INKJET PRINTER

CROSS REFERENCE TO RELATED APPLICATIONS

The present invention is related to U.S. Pat. No. 6,273,542, filed concurrently herewith, by Douglas W. Couwenhoven, et al., and titled, "METHOD OF COMPENSATING FOR MALPERFORMING NOZZLES IN AN INKJET PRINTER"; and, U.S. patent application Ser. No. 09/119,909, filed Jul. 21, 1998, titled "PRINTER AND METHOD OF COMPENSATING FOR INOPERATIVE INK NOZZLES IN A PRINT HEAD", by Xin Wen, et al., assigned to the assignee of the present invention. The disclosure of these related applications are incorporated herein by reference.

FIELD OF THE INVENTION

This invention generally relates to ink jet printing methods and more particularly relates to a method of compensating for malperforming or inoperative ink nozzles in a multitone ink jet printhead, so that high quality images are printed although some ink nozzles are malperforming or inoperative.

BACKGROUND OF THE INVENTION

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

It is known that high quality printing by an ink jet printer requires repeated ejection of ink droplets from ink nozzles in the printer's printhead. However, some of these ink nozzles may malperform, and may eject droplets that do not have the desired characteristics. For example, some malperforming nozzles may eject ink droplets that have an incorrect volume, causing the dots produced on the page to be of an incorrect size. Other malperforming nozzles may eject drops with an improper velocity or trajectory, causing them to land at incorrect locations on the page. Also, some malperforming nozzles may completely fail to eject any ink droplets at all. When such malperforming nozzles are present, undesirable lines and artifacts will appear in the printed image, thereby degrading image quality.

Malperforming and inoperative nozzles may be caused, for example, by blockage of the ink nozzle due to coagulation of solid particles in the ink. Techniques for purging clogged ink nozzles are known. For example, U.S. Pat. No. 4,489,335 discloses a detector that detects nozzles which fail to eject ink droplets. A nozzle purging operation then occurs when the clogged ink nozzles are detected. As another example, U.S. Pat. No. 5,455,608 discloses a sequence of nozzle clearing procedures of increasing intensity until the nozzles no longer fail to eject ink droplets. Similar nozzle clearing techniques are disclosed in U.S. Pat. No. 4,165,363 and U.S. Pat. No. 5,659,342.

Another reason for nozzle malperformance may be due to failures in electric drive circuitry which provides a signal that instructs the nozzle to eject a drop of ink. Also, mechanical failures in the nozzle can cause it to malperform, such as failure of the resistive heating element in thermal inkjet printer nozzles. Nozzle clearing techniques as described above cannot repair failed resistive heaters or failed electric driver circuits which may cause nozzles to permanently malperform. Of the course, presence of such permanently malperforming or inoperative nozzles compromises image quality.

European Patent Application EP 0855270A2 by Paulsen et al discloses a method of printing with an inkjet printhead even though some of the nozzles have failed permanently. As understood, this method provides for disabling portions, or "zones", of the printhead that contain failed nozzles, and printing with the remaining zones containing functional nozzles. However, this method is has a draw back in that if all zones contain a failed nozzle, then correction is not possible. Also, the presence of any failed nozzles will increase the printing time considerably.

Other methods of compensating for malperforming nozzles are known that utilize multiple print passes. The concept of using multiple print passes to improve image quality is disclosed in U.S. Pat. No. 4,967,203 to Doan et al. In this method, which is referenced for its teachings, the image is printed using two interlaced print passes, where a subset of the image pixels are printed on a first pass of the printhead, and the remaining pixels are filled in on the second pass of the printhead. The subset of pixels is defined such that the pixels are spatially dispersed. This allows time for the ink to dry before the remaining pixels are filled in on the second pass, thereby improving image quality. Printing images using multiple print passes has another benefit in that for each nozzle there is at least one other nozzle that is capable of printing along the same path during the next (or previous) pass. This is used advantageously by Wen et al in the above cross referenced patent application, which discloses a method for compensating for failed or malperforming nozzles in a multipass print mode by assigning the printing function of a malperforming nozzle to a functional nozzle which prints along substantially the same path as the malperforming nozzle. This is possible when the functional nozzle is otherwise inactive over the pixels where the malperforming nozzle was supposed to print. However, this technique does not apply when it is required that ink be printed at a given pixel by more than one nozzle. In high quality inkjet systems, this is often desirable, as described hereinbelow.

To further improve image quality, modern inkjet printers provide for new ways of placing ink on the page. For example, several drops of ink may be deposited at a given pixel, as opposed to a single drop. Additionally, the plurality of ink drops placed at a given pixel may have different drop volumes and/or densities. Examples of these high quality inkjet systems are disclosed in U.S. Pat. Nos. 4,560,997 and 4,959,659. Each particular way that ink can be placed at a given pixel by one pass of a nozzle is called a "state". Different states may be created by varying the volume and/or density of the ink drop. The reason that this is done is that increasing the number of states in an inkjet printer increases the number of density levels that can be used to reproduce an image, which increases the image quality. For example, consider a binary inkjet printer that can place at each pixel either no drop or a single large (L) drop of fixed volume and density during a single print pass. This printer has only two states (per color), denoted as: (0) and (L). Correspondingly, this binary printer has only 2 fundamental density levels, and the intermediate densities are achieved by halftoning between the two available states. Now consider a modern inkjet printer that can print either no drop, a small drop (S), or a large drop (L) of a fixed density. This modern printer has three states: (0), (S), and (L). Taking this one step further; if the modern inkjet printer prints in a 2 pass interlaced mode, as discussed earlier, then two states can be placed at any given pixel. The number of fundamental density levels will be equal to the number of combinations of the available states (3) into groups of 2 (one state printed on each pass). In this case, the number of fundamental density levels will be six: (0,0), (0,S), (S,S), (0,L), (S,L), and (L,L). The intermediate densities are again created by halftoning between the available density levels, but as someone skilled in the art will know, the more density levels there are to render an image, the better the image quality will be.

To produce some of the fundamental density levels, more than one nozzle must be activated for a given pixel location during the printing process. For example, in a two pass interlaced print mode, printing a state of (S,L) at a given pixel location on the page requires that both of the nozzles that pass over the pixel are activated. This violates the constraints of the above discussed methods for correcting for malperforming nozzles. Thus, a different method of correcting for malperforming nozzles is required to achieve improved image quality on modem inkjet printers.

In a multiple pass print mode, one line of image pixels along the fast scan direction is printed by a group of ink nozzles with each ink nozzle printing that particular line of image pixels in each printing pass. If one of the ink nozzles in the group is malperforming (or inoperative), the printing job originally assigned to the malperforming nozzles can be assigned to a functional ink nozzle in that nozzle group, as described above. One shortcoming of this technique of correcting failed nozzles is that it does not adequately address all the possible situations of ink drop states. For example, in the above mentioned example, six density levels are produced by six sets of ink drop states: (0,0), (0,S), (S,S), (0,L), (S,L), and (L,L). The ink drop states (S,S), (S,L), and (L,L) do not have a (0) state within each of the ink state set. To use the above described correction method for malperforming nozzles requires abandoning at least one of the ink drop states in each of the ink drop sets; the abandoned ink drop state corresponding to the malperforming ink nozzle. The loss of one (or more) ink drop states will often significantly decrease the optical density below the intended density values. Although better than no compensation, this method for correcting malperforming nozzles still cannot completely eliminate image artifacts. Visible banding still exists on the printed image even if the digital image file is processed for this correction.

SUMMARY OF THE INVENTION

An object of the present invention is to provide a method of compensating for malperforming and inoperative ink nozzles in a multitone inkjet printer, so that high quality images are printed although some ink nozzles are malperforming or inoperative. With this object in view, the present invention provides for a method of compensating for at least one malperforming nozzle in an inkjet printing device having a printhead with a plurality of nozzles which are organized in nozzle groups, each nozzle group including a first nozzle which prints along a first row of image pixels, and at least a second nozzle which is capable of printing along substantially the same row of image pixels as the first row of image pixels, said nozzles adapted to printing an optical density at the image pixels using two or more states on a receiver in responsive to a swath data signal, wherein each state corresponds to a volume of ink that is desired to be emitted by a nozzle and a zero state corresponds to no ejection of an ink drop, comprising the steps of:

a) relating each optical density at an image pixel to a plurality of sets of states, and said sets of states being sequenced by the number of zero states in each set;

b) assigning a set of states to the image pixel wherein the number of zero states is at least equal to the number of malperforming nozzles in the nozzle group;

c) receiving the swath data signal and assigning a zero state in a set of states corresponding to a optical density on the receiver to each malperforming nozzle in the nozzle group, thereby producing a modified swath data signal; and, d) printing the image pixels according to the modified swath data signal.

ADVANTAGEOUS EFFECT OF THE INVENTION

An advantage of the present invention is that high quality images are printed although some of the ink nozzles are malperforming or inoperative.

Another advantage of the present invention is that the malperforming or inoperative ink nozzles can be effectively compensated without substantial loss of density in the set of the ink drop states for each image pixel.

A feature of the present invention is that the malperforming or inoperative ink nozzles can be compensated for the set of ink drop states wherein none of the ink drop state is a zero state.

A further advantage of the present invention is that lifetime of the printhead is increased and therefore printing costs are reduced.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

FIG. 4 is a data table showing nozzle malperformance values for a hypothetical 24 nozzle printhead;

FIG. 5 is a data table showing state importance values for three states that a nozzle can produce;

FIG. 9 shows a look-up table wherein each optical density printed on a receiver is related to a plurality of sets of states and the sets of states are sequenced by the number of zero states in each set; and, FIG. 10 is a figure showing a printhead and portion of an image printed on three subsequent passes where malperforming nozzles have been compensated in accordance with another embodiment of the present invention.

DETAILED DESCRIPTION OF THE INVENTION

Figure 1:
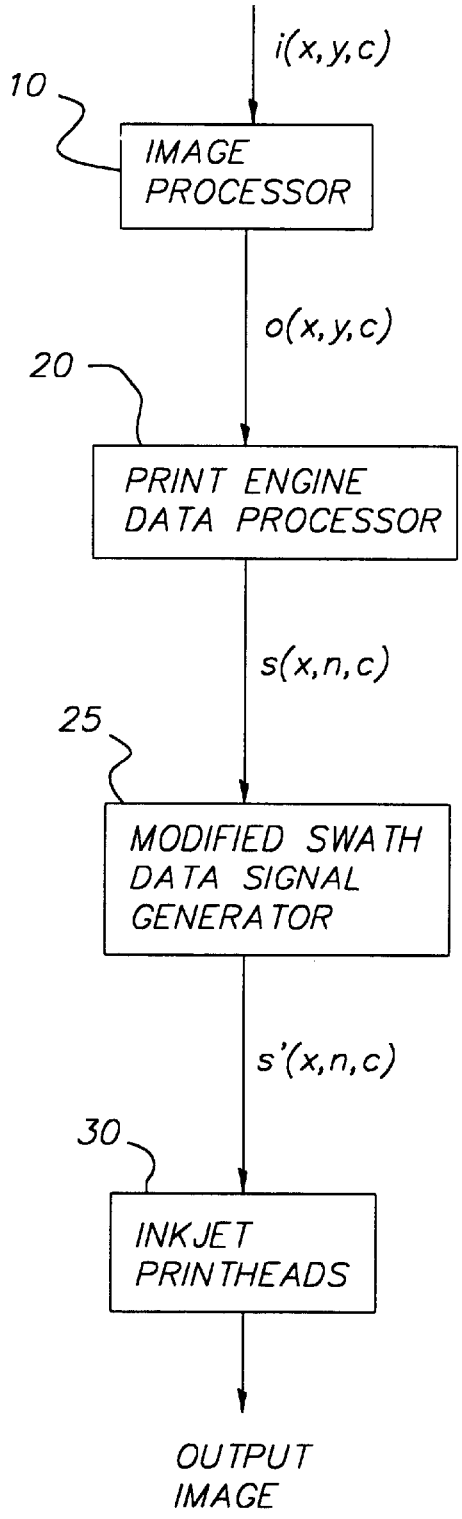
FIG. 1 is a block diagram showing the generic image processing steps involved with preparing image data for an inkjet printer.

Referring to FIG. 1, there is shown a block diagram which shows the steps generally involved in processing image data for an inkjet printer. The input image signal is denoted by i(x,y,c), where x and y are spatial coordinates, and c is a color coordinate signifying the different color channels of the image. The input image signal i(x,y,c) is generally represented as an array of digital data values, typically expressed as numbers on the range (0,255). An image processor 10 receives the input image signal i(x,y,c), and generates an intermediate image signal o(x,y,c). The image processor 10 typically includes image manipulation functions such as sharpening, resizing, color transformation, rotation, halftoning (or multitoning), etc. The image processor 10 may reside inside the inkjet printer, but is more commonly implemented in a software program on a host computer that is connected to the inkjet printer. A print engine data processor 20 then receives the intermediate image signal o(x,y,c) and produces a swath data signal s(x,n,c), where n represents the nozzle number. The swath data signal is generally a reformatted version of the intermediate image signal o(x,y,c) that has been properly formatted for multipass printing with an inkjet printhead containing a discrete number of nozzles. In other words, the swath data signal s(x,n,c) contains the data that will be sent to the printhead to print one pass of the image. Each row of the swath data signal s(x,n,c) is represented by a particular value of n, and contains the data that will be printed by nozzle n during the given pass. A modified swath data signal generator 25 receives the swath data signal s(x,n,c) and generates a modified swath data signal s'(x,n,c) according to the present invention, described in detail hereinbelow. Finally, a set of inkjet printheads 30 (typically one for each ink color), receives the modified swath data signal s'(x,n,c) for all of the passes required to print the image, and places the ink on the page accordingly to form the output image.

Figure 2:
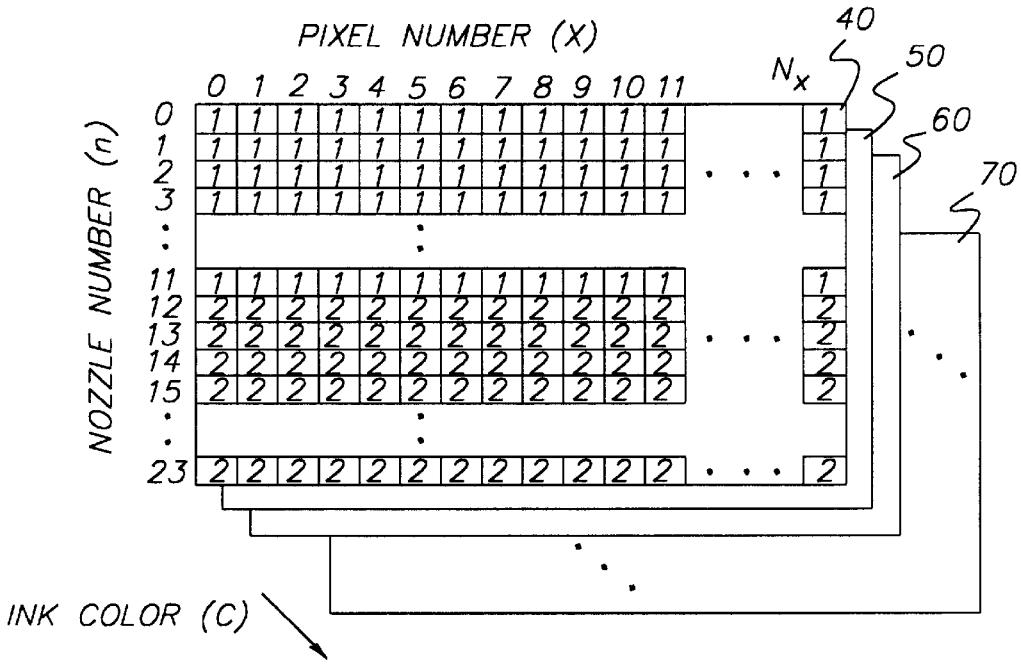
FIG. 2 is a data table showing a swath data signal.

Turning now to FIG. 2, there is shown a data table 40 which represents the swath data signal s(x,n,c) for one pass of one color of a sample image. Each row of the table contains the data that will be printed by one nozzle of the printhead during the given pass. For purposes of explanation, the printhead is assumed to have twenty four nozzles numbered $n_0$–$n_{23}$, and hence the swath data signal has twenty four rows. However, the number of nozzles is not of importance to the present invention, which will apply to any printhead design. The number of columns in the data table shown in FIG. 2 is equal to the number of pixels in the image, shown here to be $N_x$, and the number of data tables 40, 50, 60, 70 is equal to the number of ink colors in the printer. Each element of the data table 40 represents the state that will be printed at a given pixel by a given nozzle in the current pass. In this particular example, nozzles $n_0$–$n_{11}$ are printing state "1", and nozzles $n_{12}$–$n_{23}$ are printing state "2" at each pixel.

Figure 3:
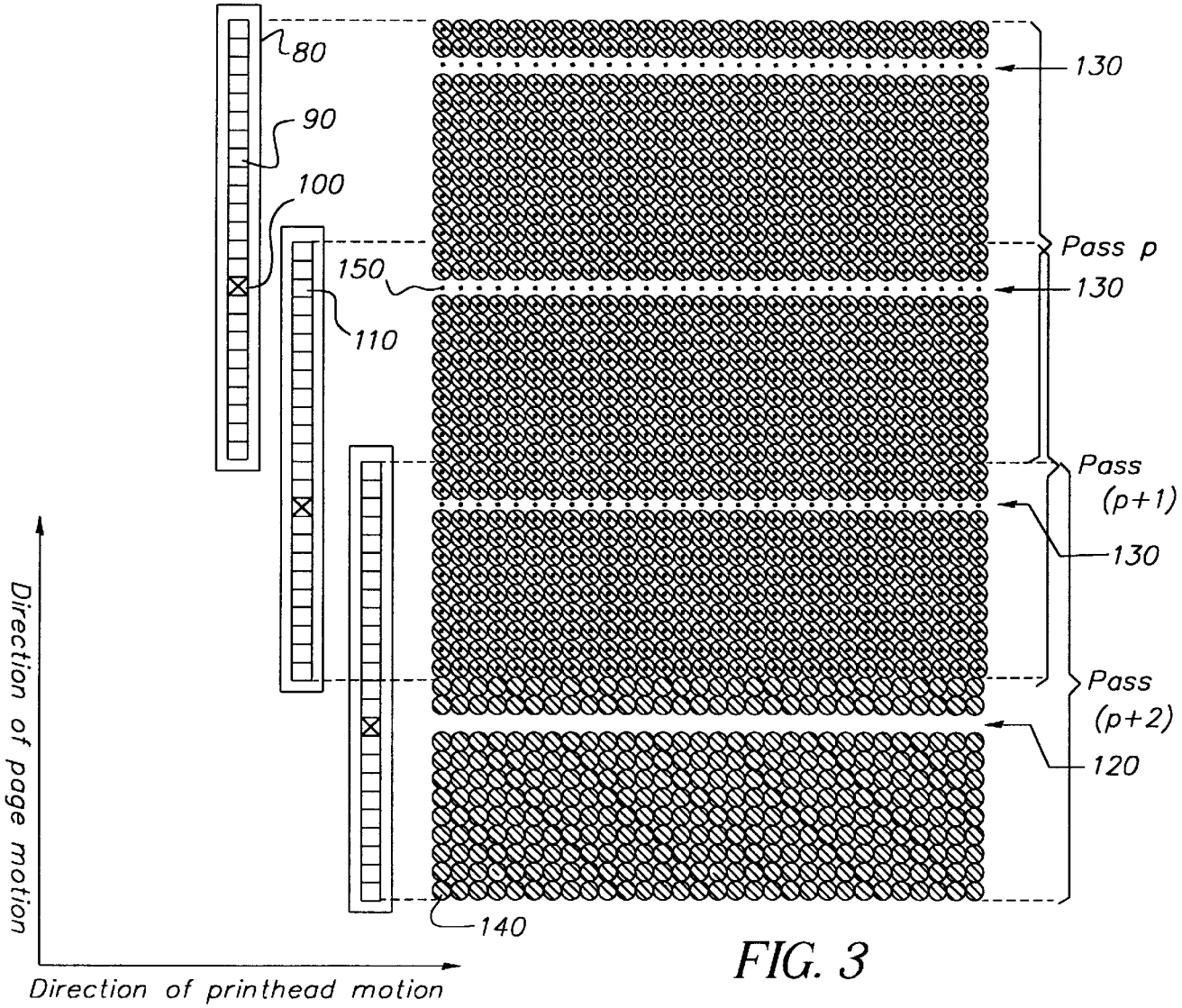
FIG. 3 is a figure showing a printhead and portion of an image printed on three subsequent passes.

Referring now to FIG. 3, there is shown an inkjet printhead 80 with twenty four nozzles 90 which are used to eject drops of ink onto a receiver medium according to the swath data signal using a two pass interlaced printmode. The twenty four nozzles are numbered $n_0$–$n_{23}$ so that nozzle no is at the top of the printhead 80 and nozzle $n_{23}$ is at the bottom. As the printhead 80 scans from left to right across the page (as indicated by the horizontal arrow at lower left), the ejected ink drops form an image composed of ink dots. After the printhead 80 completes a scan, also referred to as a "swath", "pass", or "print pass", the receiver medium is advanced in a perpendicular direction (as indicated by the vertical arrow at lower left) by a distance equal to half of the printhead height. At the same time, the printhead retraces back across the page and prepares to print dots on the next pass. Still referring to FIG. 3, a portion of a sample image resulting from three passes of the printhead 80 is shown, wherein the passes are labeled "Pass p", "Pass (p+1)", and "Pass (p+2)". For clarity of understanding the image formation process, the printhead 80 is shown at three different locations in FIG. 3, representing the printing of three subsequent passes. In actuality, the printhead 80 has not moved vertically, but rather the page has moved vertically between the passes. It should be noted that the present invention will apply to any number of print passes, as long as at least one nozzle is capable of printing along the same path as one other nozzle. A two pass print mode was chosen to describe the present invention because of its relative simplicity. Also referring to FIG. 3, the printhead 80 contains a malperforming nozzle $n_{14}$ 100 that is inoperative and is not ejecting ink when commanded. This results in a horizontal white line 120 and partially printed lines 130, which are undesired and greatly reduce the quality of the printed image.

In this sample image, the same fundamental density level is desired to be printed at each pixel location, and consists of the superposition of one small dot corresponding to state "1" of a given ink, and one large dot corresponding to state "2" of the same ink. In this example, the large ink dots 140 corresponding to state "2" are printed using nozzles $n_{1214}$ $n_{23}$, and the small ink dots 150 corresponding to state "1" are printed using nozzles $n_0$–$n_1$ according to the data table shown in FIG. 2. In this way, over two passes, each pixel will receive a large and a small dot, which is the desired image. It should be noted that this particular approach to spatially distributing the large and small ink dots over the two print passes is just one particular design decision, and is not fundamental to the invention. It is also understood that in the current example, the volume of ink ejected by each nozzle can be varied from pixel to pixel. In any case, the nozzle $n_{14}$ 100 malperforms, which results in a white line 120 and partially printed lines 130. The dots that are present in the partially printed lines 130 are printed by nozzle $n_2$ 110, which prints along the same path as malperforming nozzle $n_{14}$ 100, but on the subsequent pass. The set of nozzles that are capable of printing along the same path are called a "nozzle group". Hence, nozzle $n_2$ 110 and $n_{14}$ 100 form a nozzle group. In the current example of a two pass printmode, each nozzle group contains two nozzles; one from the bottom half of the printhead 80 and a corresponding nozzle from the upper half. Printing the desired fundamental density level in this example requires that both nozzles in any nozzle group are active. Since nozzle $n_2$ 110 is active for each pixel in the partially printed lines 130, it is not possible to re-route the command signals for malperforming nozzle $n_{14}$ 100 to nozzle $n_2$ 110 as described by Wen et al.

To compensate for malperforming nozzles according to the present invention, each nozzle is assigned a malperformance value which indicates the severity of the malperformance. The assignment of a malperfornance value for each nozzle could be in response to a printed test pattern or signal from a detector that measures nozzle performance attributes such as drop trajectory and volume, or whether the nozzle has failed. In a preferred embodiment of the present invention, the nozzle malperformance value for a given nozzle will depend on the dot placement accuracy, deviation from ideal drop volume, and fail state of the nozzle according to:

$$m(n)=w_e\sqrt{e_{n,x}^2+e_{n,y}^2}+w_v|v_n-v_{ideal}|+w_f f_n \quad \text{(EQ.1)}$$

where m(n) is the malperformance value for nozzle n; $e_x$ and $e_y$ are the horizontal and vertical dot placement errors (in microns) for nozzle n; $v_n$ is the volume of drops produced (in picoliters) by nozzle n; $v_{ideal}$ is the ideal desired drop volume (in picoliters); $f_n$ is a logical value indicating whether nozzle n produces ink (0) or is failed (1); and $w_e$, $w_v$, $w_f$ are weighting factors. In a preferred embodiment, values for the weights $w_e$, $w_v$, and $w_f$ are 1, 0.1, and 50, respectively. As someone skilled in the art will recognize, there are many different formulas that are appropriate for calculating the nozzle malperformance value m(n). For example, consistency of dot volume and placement accuracy by a given nozzle may also be considered when computing the nozzle malperformance value. Turning now to FIG. 4, there is shown a data table indicating the malperformance values for nozzles $n_0$–$n_{23}$. The values in the table are example values, where a small value indicates that the nozzle has good performance, and a large value indicates that the nozzle has poor performance. Notice that nozzle $n_{14}$ has a large malperformance value, due to the fact that it has failed completely, and nozzle $n_2$ has a small malperformance value, indicating that it is operating correctly. Other nozzles have intermediate values, indicating the relative level of malperformance between them. The computation of the data in the table of FIG. 4 need only be computed once for a given printhead, but as the printhead gets used, the performance of the nozzles will change and degrade the image quality. Consistent image quality can be achieved if the nozzle performance data is updated periodically over the life of the printhead. This data can be gathered by a number of different methods, including the use of an optical detector to sense the ejection of ink drops from the nozzles, or to scan a printed test pattern.

Also in accordance with the present invention, each state is assigned a state importance value indicating the relative importance of printing one state versus another. In other words, if two states were desired to be printed at a given pixel, but it was only possible to print one of the states because one of the nozzles in the nozzle group for the current pixel has failed, the state importance value is used to determine which of the two states is more critical to print in order to preserve the maximum image quality. Turning now to FIG. 5, there is shown a data table containing the state importance value for each of the three available states that the printer in the example currently being discussed can print. In a preferred embodiment of the present invention, the state importance value will be calculated from the dot volume, size, and density according to:

$$j(s)=w_d d_s+w_v v_s+w_r r_s \quad \text{(EQ.2)}$$

where j(s) is the importance value for state s; $d_s$, $v_s$, and $r_s$ are the density, volume (in picoliters), and radius (in microns) of the dot corresponding to state s; and $W_d$, $w_v$, $w_r$ are weighting factors. In a preferred embodiment, values for the weights $w_d$, $w_v$, and $w_r$ are 1, 1, and 1, respectively. Again, one skilled in the art will recognize that many different formulas are appropriate for calculating the state importance value, and that the state importance value may be a function of other variables not listed here, such as dot shape, sharpness, receiver media type, ink type, etc. What is relevant to the present invention is that the state importance value indicates the relative image quality importance of the state. As shown by the example state importance values in FIG. 5, state "2" has a larger importance value than state "1", because it is a larger dot. State "0" refers to the absence of ink at a given pixel, and is therefore assigned a state importance value of 0. The computation of the data shown in the table of FIG. 5 need only be performed once for a given ink and receiver media combination.

Figure 7:
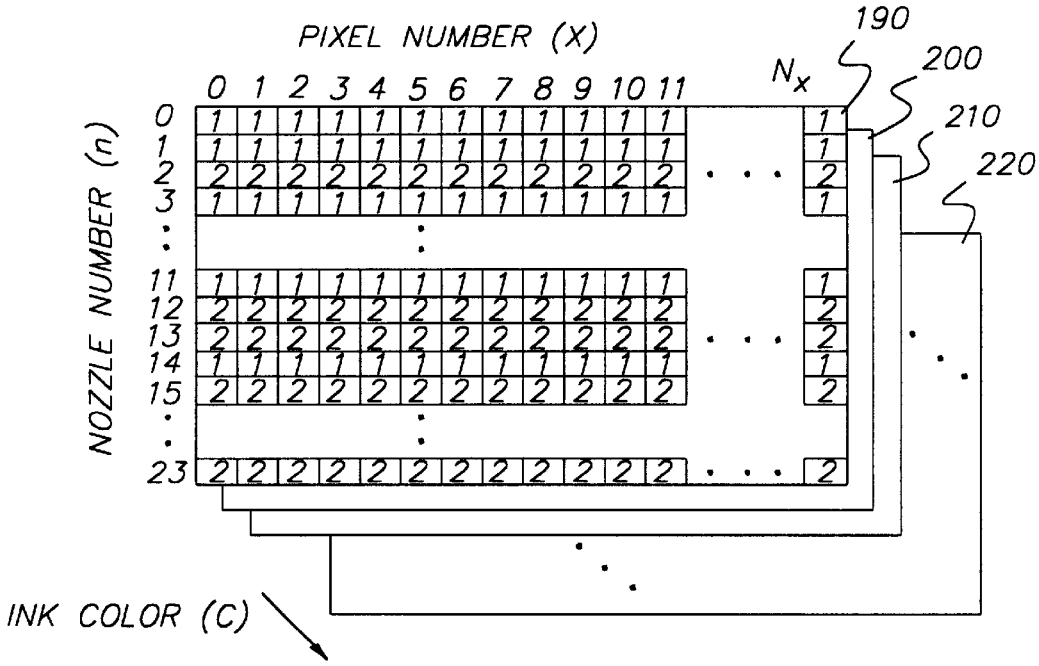
FIG. 7 is a data table showing a modified swath data signal in accordance with the present invention.
Figure 6:
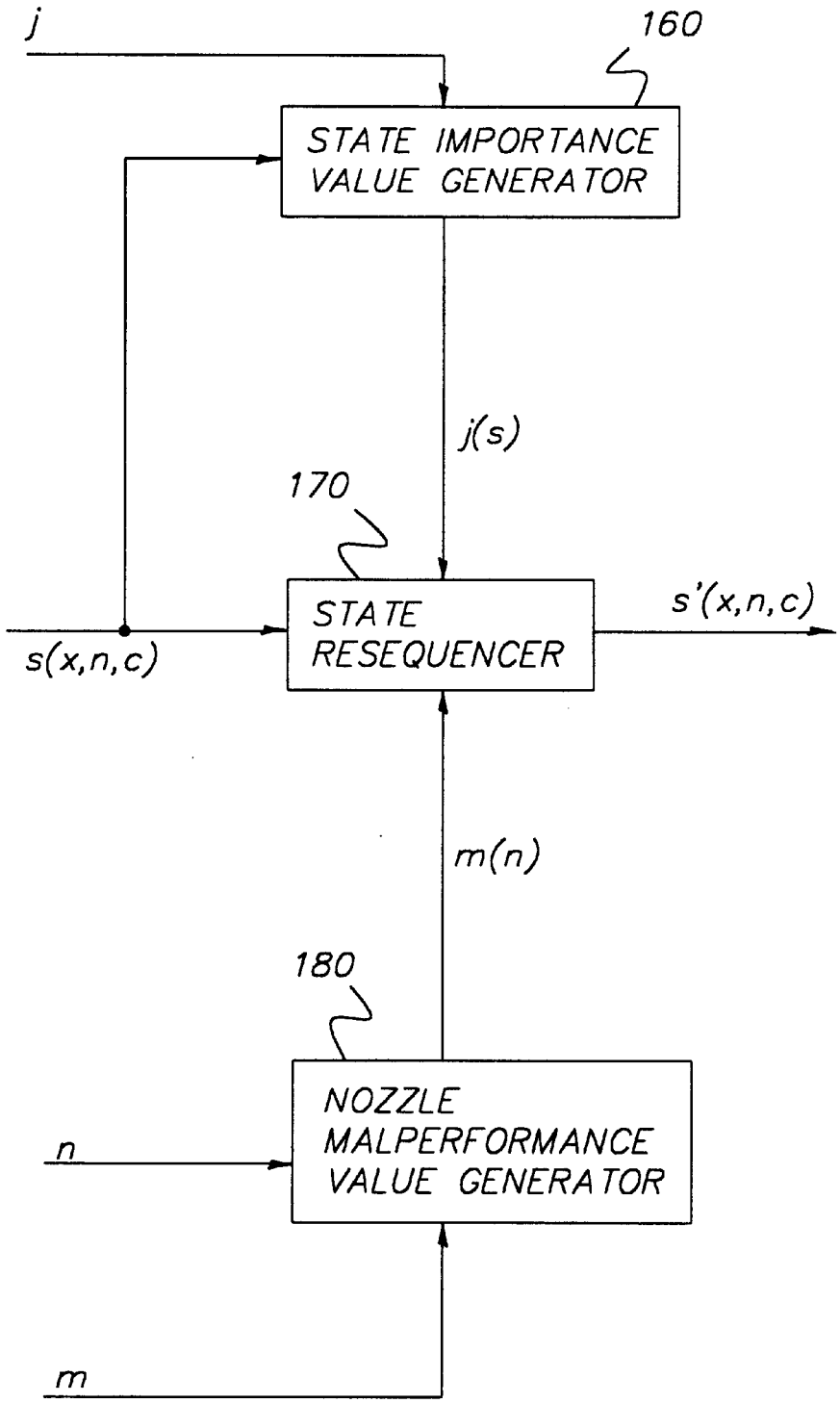
FIG. 6 is a block diagram showing the details of the modified swath data signal generator of FIG. 1.

Once the nozzle malperformance values and state importance values have been calculated, this information is used to maximize the image quality and compensate for malperforming nozzles as described hereinbelow. Turning now to FIG. 6, which shows the details of the modified swath data signal generator 25 of FIG. 1, a state importance value generator 160 receives the swath data signal s(x,n,c) and the state importance table j, and produces a state importance value j(s) by extracting the appropriate value from the state importance table j shown in FIG. 5. Still referring to FIG. 6, a nozzle malperformance value generator 180 receives the nozzle number n and the nozzle malperformance table m shown in FIG. 4, and produces the nozzle malperformance value m(n) by selecting the appropriate value from the nozzle malperformance table. A state resequencer 170 then receives the nozzle malperformance value m(n), the state importance value j(s), and the swath data signal s(x,n,c) and produces a modified swath data signal s'(x,n,c). In one embodiment of the present invention, the state resequencer 170 creates the modified swath data signal s'(x,n,c) such that within the nozzle group used to print each pixel, the nozzle with the highest malperformance value is used to print the state with the lowest state importance value. FIG. 7 shows a data table 190 representing the modified swath data signal s'(x,n,c) for one swath of one color of the sample image discussed hereinabove. In the data table 190, the states printed by nozzles $n_{14}$ and $n_{12}$ have been swapped from the original data table 40 of FIG. 2. This is because nozzle $n_4$ has a larger nozzle malperformance value than nozzle n2, but nozzle $n_{14}$ was originally going to print state "2", which has a higher state importance value than state "1", which was originally going to be printed by nozzle $n_2$. Nozzles $n_{14}$ and $n_2$ belong to the same nozzle group, and therefore are capable of printing along the same path. Thus, according to the present invention, the modified swath data signal s'(x,n,c) was created such that for each pixel, the nozzle with the highest malperformance value was used to print the state with the lowest importance value.

Figure 8:
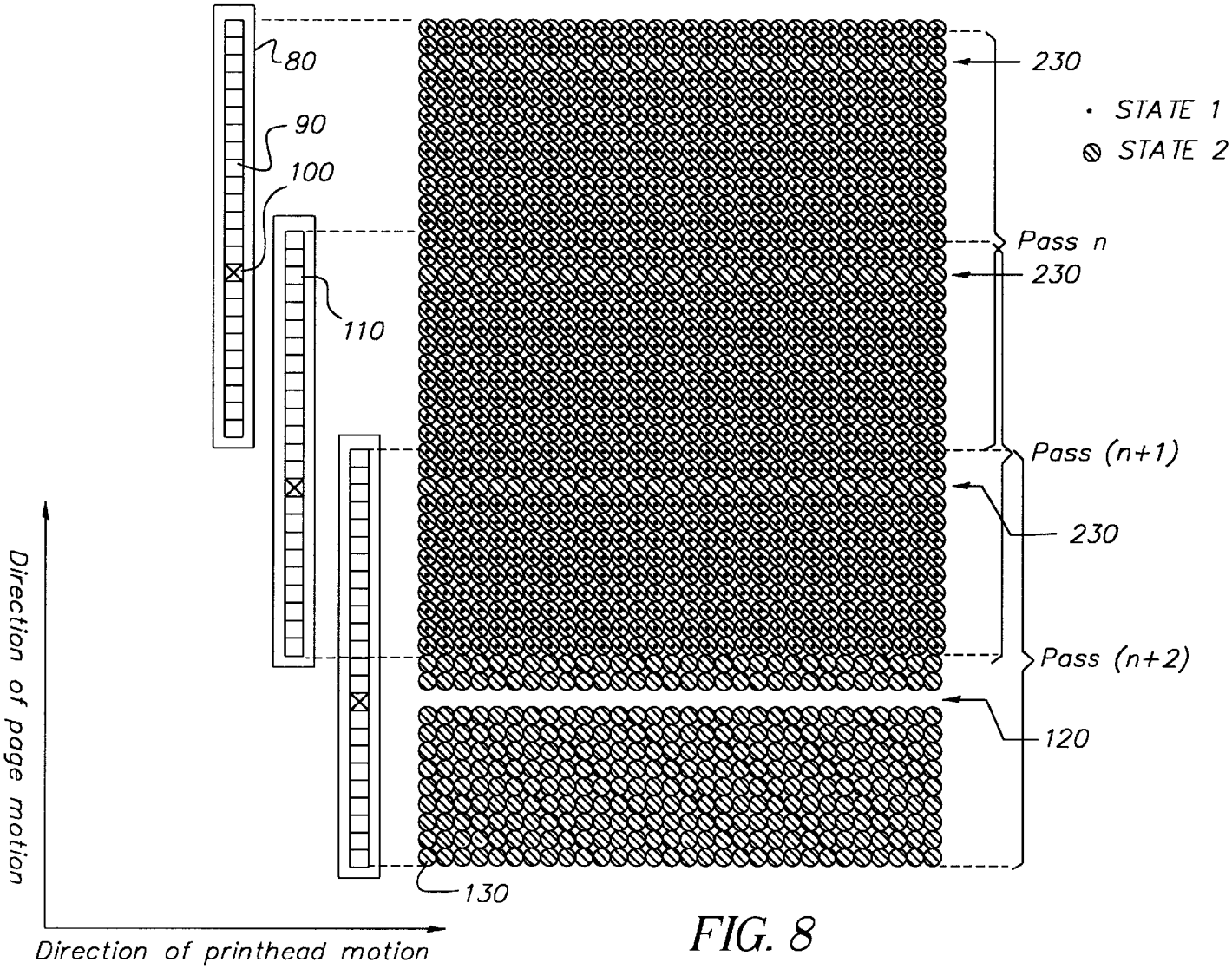
FIG. 8 is a figure showing a printhead and portion of an image printed on three subsequent passes where malperforming nozzles have been compensated in accordance with one embodiment of the present invention.

Referring now to FIG. 8, which shows a first embodiment of the present invention, there is shown the sample image printed according to the modified swath data signal s'(x,n,c). Comparing the image of FIG. 8 with the image of FIG. 3, which was printed with the original swath data signal s(x,n,c), it is seen that the objectionability of the partially printed lines 230 of FIG. 8 has been greatly reduced when compared to the partially printed lines 130 of FIG. 3. The partially printed lines 230 are more visually pleasing because the banding effect has been reduced by printing the more important states according to the table of FIG. 5. Note that the white line 120 is still present in the image of FIG. 8, but it will be filled in on the next pass with a large dot by nozzle $n_2$.

Referring back to FIG. 6, there are other embodiments of the state resequencer 170 that may be implemented according to the present invention. For example, a cost function which depends on the state importance value and the nozzle malperformance value can be computed according to:

$$C=\sum_i m(n_i)j(s_i) \quad \text{(EQ. 3)}$$

where C is the cost; m is the nozzle malperformance value for nozzle $n_i$; j is the state importance value for state $s_i$; and i iterates over the number of nozzle-state pairings for the given pixel. If the nozzle malperformance value is constructed such that larger values indicate poor performance, and the state importance value is constructed such that larger values indicate higher importance, then minimizing the cost function C will maximize the image quality.

In a variation of the first embodiment of the state resequencer 170 of FIG. 6, the nozzles belonging to the nozzle group that prints a given pixel are sorted in order of increasing nozzle malperformance value to form a nozzle performance list. The nozzles near the beginning of the list will have lower nozzle malperformance values, indicating that they are relatively good nozzles to use. Nozzles near the end of the list will have higher nozzle malperformance values, indicating that they will produce poorer image quality. The states that are to be printed at a given pixel, as defined by the swath data signal, are sorted in order of decreasing state importance value to form a state importance list, so that states near the beginning of the list are more important than states near the end of the list. The assignment of which nozzle gets used to print which state is then made by matching the nozzle in a given position in the nozzle performance list with the state in the corresponding position of the state importance list. These assignments are then stored in the modified swath data signal. In this way, the better performing nozzles will be used to produce the more important states, thereby improving the image quality.

In a second embodiment of the present invention, FIG. 9 shows a look-up table for relating each optical density printed on a receiver to a plurality of sets of states. The sets of states corresponding to each density are arranged into columns according to the required number of zero states in each set. Specifically, there are a plurality of optical densities $D_0$, $D_1$, $D_2$ . . . $D_i$ . . . $D_{max}$, that can be printed by the ink jet printing apparatus at an image pixel on the receiver. Each density can be printed by a plurality of sets of ink states as listed in columns $A_0$ and $A_1$. For the column $A_0$, each set of states is not required to possess a zero state (i.e. (0) state). For the column $A_0$, each set of states must have at least one zero state. For example, the optical density $D_i$ can be printed by a state set (1,2) in column $A_0$ or a state set (0,3) in column $A_1$. The look-up table shows two states contained in each state set, that is, each set of states can be printed by two or more printing passes. It is understood that in general, there can be more than two columns $A_i$ (i=0, 1, 2 . . . , n) in the look-up table. Each optical density in the look-up table can be printed by n+1 sets of states that can be printed in (n+1) or more passes.

Figure 10:
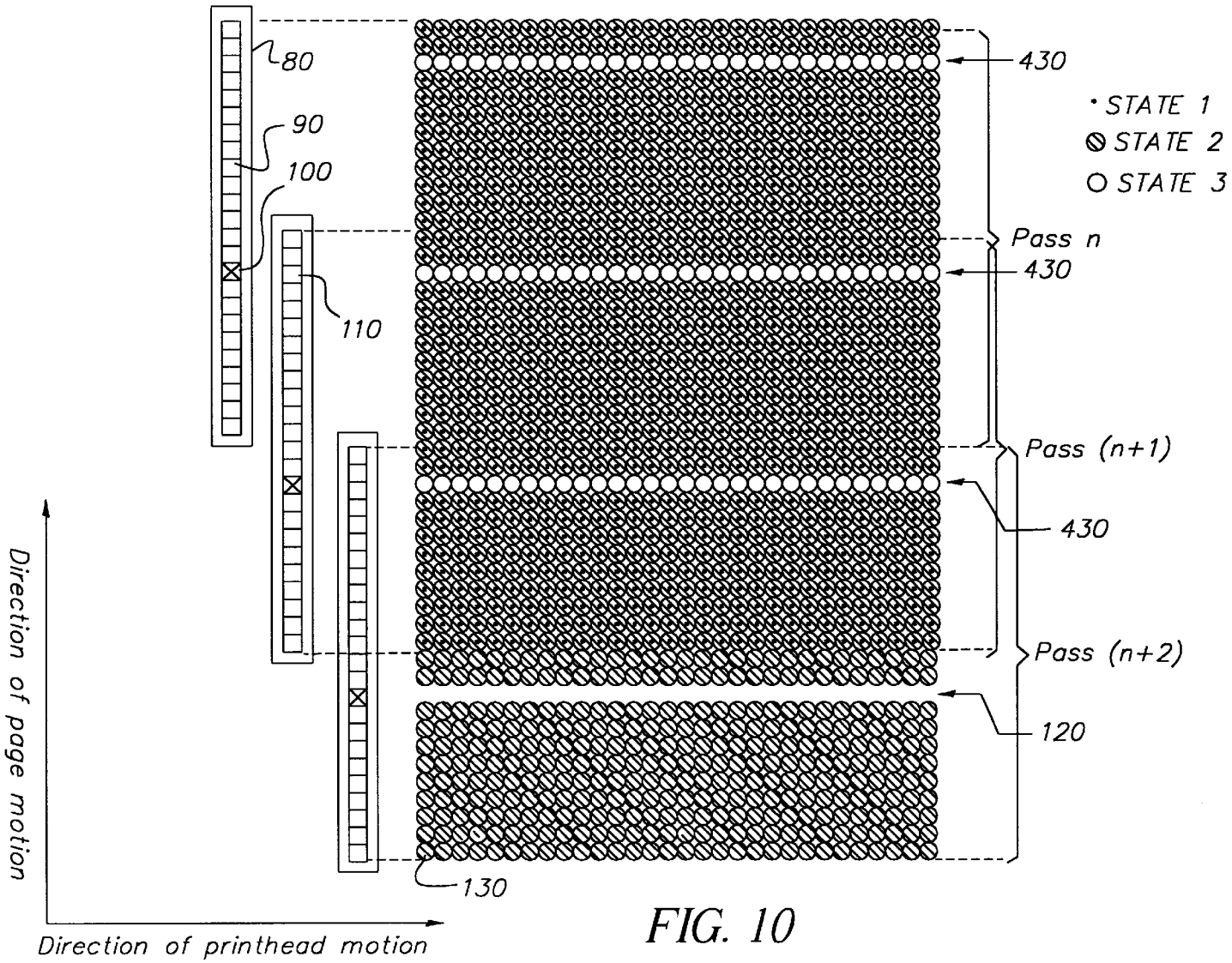

FIG. 10 illustrates the embodiment of the present invention as described in FIG. 9. FIG. 10 shows a print head and portion of an image printed on three subsequent passes in a two-pass mode. The malperforming nozzles have been compensated using the look-up table in FIG. 9. A uniform image area of print density $D_i$ is printed in FIG. 10. As shown in the look-up table in FIG. 9, the optical density $D_i$ is usually printed by the state set (1,2) represented by the a small circle (state (1) and a large light circle (state (2)). A white line artifact 120 was left in the first printing pass due to an inoperative nozzle (or malperforming nozzle in general). Thus, a state (2) is not printed on that line. In the first embodiment of the present invention, wherein the state set is kept the same, a state (2) is printed in the second pass in the place of a state (1). This reduces the visibility of the line image artifact. In the present embodiment, the state set (1,2) (in column $A_0$) in the original swath data signal is replaced by a new state set (0,3) (in column $A_1$) as shown in the look-up table of FIG. 9. Thus, a state (3) is printed in the second pass to form a compensating print line 430 over the white line artifact 120. Since the state sets (0,3) and (1,2) are both corresponding to the printed optical density $D_I$, the visibility of image artifact is essentially eliminated.

In a third embodiments in the present invention, the two above mentioned embodiments of the present invention are combined so that each printed optical density is related to a plurality sets of states. Within each state set, the state having the highest state importance value is assigned to the nozzle having the lowest nozzle malperformance value. The two above mentioned embodiments can be viewed as a specific case of the third embodiment. For example, in the second embodiment of the present invention, the nozzle with the highest malperformance value is assigned to a zero state by properly selecting the state set.

The invention has been described in detail with particular reference to certain preferred embodiments thereof, but it will be understood that variations and modifications can be effected within the spirit and scope of the invention.

| PARTS LIST | |
|---|---|
| 10 | Image processor |
| 20 | Print engine data processor |
| 25 | Modified swath data signal generator |
| 30 | Inkjet printheads |
| 40 | Swath data signal table |
| 50 | Swath data signal table |
| 60 | Swath data signal table |
| 70 | Swath data signal table |
| 80 | Printhead |
| 90 | Inkjet nozzles |
| 100 | Malperforming inkjet nozzle |
| 110 | Inkjet nozzle |
| 120 | White line artifact |
| 130 | Partially printed line artifacts |
| 140 | Large ink dots |
| 160 | State importance value generator |
| 170 | State resequencer |
| 180 | Nozzle malperformance value generator |
| 190 | Modified swath data signal table |
| 200 | Modified swath data signal table |
| 210 | Modified swath data signal table |
| 220 | Modified swath data signal table |
| 230 | Partially printed line |
| 430 | Compensating print line |

What is claimed is:

1. A method of compensating for at least one malperforming nozzle in an inkjet printing device having a printhead with a plurality of nozzles which are organized in nozzle groups, each nozzle group including a first nozzle which prints along a first row of image pixels, and at least a second nozzle which is capable of printing along substantially the same row of image pixels as the first nozzle, said nozzle groups adapted to print multiple ink droplets of various sizes at a single pixel location using two or more states on a receiver in response to a swath data signal, wherein each state corresponds to a volume of ink that is desired to be emitted by a nozzle and a zero state corresponds to no ejection of an ink drop, comprising the steps of:

a) relating each optical density at an image pixel to a plurality of sets of states including one state corresponding to a first droplet volume and a second state corresponding to a second, larger droplet volume, wherein said plurality of said sets of states result in substantially the same optical density and each of said sets of states are sequenced by the number of zero states in the set;

b) assigning a set of states to the image pixel wherein the number of zero states is at least equal to the number of malperforming nozzles in the nozzle group;

c) receiving the swath data signal and assigning a zero state in a set of states corresponding to an optical density on the receiver to each malperforming nozzle in the nozzle group, thereby producing a modified swath data signal that assigns the printing data for each nonperforming nozzle to one or more performing nozzles such that the resulting inkjet printing does not result in substantial degradation of the appearance of the image pixels; and, d) printing the image pixels according to the modified swath data signal and producing substantially the same optical density as when each nozzle in the nozzle group is performing.

2. The method of claim 1 wherein compensating for the malperforming nozzles includes compensating for inoperative nozzles.

3. The method of claim 1 wherein compensating for the malperforming nozzles includes compensating for nozzles that eject ink drops with ink volumes outside of a specified ink volume range.

4. The method of claim 1 wherein compensating for the malperforming nozzles includes compensating for intermittently operative nozzles.

5. A method of compensating for at least one malperforming nozzle in an inkjet printing device having a printhead with a plurality of nozzles which are organized in nozzle groups, each nozzle group including a first nozzle which prints along a first row of image pixels, and at least a second nozzle which is capable of printing along substantially the same row of image pixels as the first nozzle, said nozzle groups adapted to print multiple ink droplets of various sizes at a single pixel location using two or more states on a receiver in response to a swath data signal, wherein each state corresponds to a volume of ink that is desired to be emitted by a nozzle and a zero state corresponds to no ejection of an ink drop, comprising the steps of:

a) relating each optical density at an image pixel to a plurality of sets of states including one state corresponding to a first droplet volume and a second state corresponding to a second, larger droplet volume, wherein said plurality of said sets of states result in substantially the same optical density and each of said sets of states are sequenced by the number of zero states in the set;

b) detecting the malperforming nozzles using a nozzle performance detector;

c) assigning a set of states to the image pixel wherein the number of zero states is at least equal to the number of malperforming nozzles in the nozzle group;

d) receiving the swath data signal and assigning a zero state in a set of states corresponding to an optical density on the receiver to each malperforming nozzle in the nozzle group, thereby producing a modified swath data signal that assigns the printing data for each nonperforming nozzle to one or more performing nozzles such that the resulting inkjet printing does not result in substantial degradation of the appearance of the image pixels; and, e) printing the image pixels according to the modified swath data signal and producing substantially the same optical density as when each nozzle in the nozzle group is performing.

6. The method of claim 5 wherein step b) includes a nozzle performance detector that is an optical detector.

7. The method of claim 5 wherein step b) includes generating nozzle performance data in response to a printed test pattern.

8. A method of compensating for at least one malperforming nozzle in an inkjet printing device having a printhead with a plurality of nozzles which are organized in nozzle groups, each nozzle group including a first nozzle which prints along a first row of image pixels, and at least a second nozzle which is capable of printing along substantially the same row of image pixels as the first nozzle, said nozzles adapted to printing optical densities at the image pixels using two or more states on a receiver in response to a swath data signal, wherein each state corresponds to a volume of ink that is desired to be emitted by a nozzle and a zero state corresponds to no ejection of an ink drop, comprising the steps of:

a) relating each optical density at an image pixel to a plurality of sets of states, each of said sets of states being sequenced by the number of zero states in the set;

b) assigning a set of states to the image pixel wherein the number of zero states is at least equal to the number of malperforming nozzles in the nozzle group, and wherein each state is assigned a state importance value;

c) assigning a nozzle malperforming value to each nozzle, said nozzle malperforming value indicating the relative image quality penalty of using the given nozzle compared to other nozzles;

d) computing a modified swath data signal in response to the swath data signal, the state importance value, and the nozzle malperformance value; and, e) printing the image pixels according to the modified swath data signal.

* * * * *

UNITED STATES PATENT AND TRADEMARK OFFICE

CERTIFICATE OF CORRECTION

PATENT NO. : 6,354,689 B1
DATED : March 12, 2002
INVENTOR(S) : Douglas W. Couwenhoven et al.

It is certified that error appears in the above-identified patent and that said Letters Patent is hereby corrected as shown below:

Column 2,
Line 4, "the" after "Of" should be deleted and inserted instead after ",". The sentence should read as follows:
-- Of course, the presence of such permanently malperforming or inoperative nozzles compromises image quality --

Line 13, [is] after "method" should be deleted and "draw back" should be -- drawback --

Column 3,
Line 62, "printing" should be -- print --
Line 64, "responsive" should be -- response --

Column 4,
Line 27, "none of the" should be -- neither --

Signed and Sealed this

Fourth Day of June, 2002

*Attest:*

*Attesting Officer*

JAMES E. ROGAN
*Director of the United States Patent and Trademark Office*